US012420988B2

(12) United States Patent
Araki et al.

(10) Patent No.: US 12,420,988 B2
(45) Date of Patent: Sep. 23, 2025

(54) CAP AND METHOD FOR MANUFACTURING CAP

(71) Applicant: DAIWA CAN COMPANY, Tokyo (JP)

(72) Inventors: Eiji Araki, Sagamihara (JP); Kenji Takagi, Sagamihara (JP); Eiji Fujishige, Sagamihara (JP)

(73) Assignee: DAIWA CAN COMPANY, Tokyo (JP)

( * ) Notice: Subject to any disclaimer, the term of this patent is extended or adjusted under 35 U.S.C. 154(b) by 62 days.

(21) Appl. No.: 18/363,988

(22) Filed: Aug. 2, 2023

(65) Prior Publication Data

US 2023/0373688 A1 Nov. 23, 2023

Related U.S. Application Data

(63) Continuation of application No. PCT/JP2022/002840, filed on Jan. 26, 2022.

(30) Foreign Application Priority Data

Feb. 4, 2021 (JP) ..... 2021-016710

(51) Int. Cl.
*B65D 41/00* (2006.01)
*B21D 51/46* (2006.01)

(52) U.S. Cl.
CPC ..... *B65D 41/005* (2013.01); *B21D 51/46* (2013.01); *B65D 2205/02* (2013.01)

(58) Field of Classification Search
CPC .... B21D 51/2623; B21D 51/46; B65D 17/02; B65D 2205/02; B65D 41/005;
(Continued)

(56) References Cited

U.S. PATENT DOCUMENTS

2018/0229900 A1 8/2018 Ross et al.
2020/0216227 A1* 7/2020 Araki ..... B29C 45/1671
(Continued)

FOREIGN PATENT DOCUMENTS

JP 2004217295 A 8/2004
JP 2015120546 A 7/2015
(Continued)

OTHER PUBLICATIONS

International Search Report and Written Opinion mailed Apr. 12, 2022 in International Application PCT/JP2022/002840.
(Continued)

*Primary Examiner* — Nathan J Jenness
*Assistant Examiner* — Madison L Poos
(74) *Attorney, Agent, or Firm* — Polsinelli LLP

(57) ABSTRACT

A cap includes: a cap body including a top plate portion and a cylindrical skirt portion; a sealing member provided in the cap body separately from the cap body so as to face the top plate portion; a plurality of locking portions arranged in a circumferential direction in the skirt portion, the locking portions protruding inward in a radial direction of the skirt portion and supporting the sealing member; a plurality of small diameter portions arranged between the top plate portion and the locking portions of the skirt portion, the small diameter portions being respectively provided on a top plate portion side of the locking portions in the axial direction; and a plurality of large diameter portions provided adjacent to the small diameter portions in the circumferential direction and having an inscribed circle diameter larger than an inscribed circle diameter of the plurality of small diameter portions.

10 Claims, 11 Drawing Sheets

(58) Field of Classification Search
CPC .. B65D 41/04; B65D 41/0407; B65D 41/045; B65D 41/325; B65D 41/348; B65D 51/16; B65D 51/1688; B65D 53/04
USPC ..... 215/316, 337, 350, 351, 252
See application file for complete search history.

(56) References Cited

U.S. PATENT DOCUMENTS

| | | | | |
|---|---|---|---|---|
| 2021/0147121 | A1 | 5/2021 | Fujishige et al. | |
| 2021/0188500 | A1 * | 6/2021 | Fujishige et al. .. | B65D 41/3466 |

FOREIGN PATENT DOCUMENTS

| | | | | |
|---|---|---|---|---|
| JP | 2017178421 | A | 10/2017 | |
| JP | 2020015548 | A | 1/2020 | |
| WO | WO-2020022306 | A1 * | 1/2020 | ..... B65D 41/3428 |
| WO | 2020054652 | A1 | 3/2020 | |
| WO | WO-2021020433 | A1 * | 2/2021 | |
| WO | WO-2021085275 | A1 * | 5/2021 | ..... B65D 41/0407 |
| WO | WO-2022168697 | A1 * | 8/2022 | ..... B21D 51/46 |

OTHER PUBLICATIONS

International Preliminary Report on Patentability mailed Aug. 17, 2023 in International Application PCT/JP2022/002840.

* cited by examiner

CAP AND METHOD FOR MANUFACTURING CAP

CROSS-REFERENCE TO RELATED APPLICATION

This application is a Continuation Application of PCT Application No. PCT/JP2022/002840, filed Jan. 26, 2022 and based upon and claiming the benefit of priority from Japanese Patent Application No. 2021-016710, filed Feb. 4, 2021, the entire contents of all of which are incorporated herein by reference.

FIELD

The present invention relates generally to a cap for sealing a can container containing a beverage and a method for manufacturing the cap.

BACKGROUND

Conventionally, a cap for sealing a mouth portion of a can container has a configuration in which a sealing member made of a resin material that comes into close contact with the mouth portion is provided on an inner surface of a cap body. As such a cap, Jpn. Pat. Appln. KOKAI Publication No. 2004-217295 and Jpn. Pat. Appln. KOKAI Publication No. 2017-178421 disclose a technique in which a cap body and a sealing member are not mutually bonded in order to reduce cap opening torque at the time of opening the cap.

PATENT LITERATURE

Patent Literature 1: Jpn. Pat. Appln. KOKAI Publication No. 2004-217295

Patent Literature 2: Jpn. Pat. Appln. KOKAI Publication No. 2017-178421

SUMMARY

For the cap described above, the sealing member is engaged with a vent slit projecting inward of a skirt portion to prevent the sealing member from falling off. However, in a case where the internal pressure of the container becomes negative, the sealing member tends to adhere to the container mouth portion side, and there is a concern that the sealing member may fall off the cap body at the time of opening the cap.

On the other hand, in a case where the vent slit is formed deeply inward in a radial direction in order to sufficiently engage with the sealing member, there is a concern that a crack may occur at an end portion of the vent slit. It is also conceivable to provide the skirt portion with a recessed portion which protrudes inward of the slitless skirt portion. However, even in a case where the sealing member is engaged with the recessed portion provided in the skirt portion, there are concerns the skirt portion may be damaged if the recessed portion is formed too deeply.

It is therefore an object of the present invention to provide a cap and a method for manufacturing the cap which can reliably prevent a sealing member from falling off without damaging a skirt portion.

BRIEF DESCRIPTION OF THE DRAWING(S)

DETAILED DESCRIPTION

According to one aspect of the present invention, a cap includes: a cap body including a top plate portion and a cylindrical skirt portion provided on a peripheral edge portion of the top plate portion; a sealing member provided in the cap body and separately from the cap body so as to face the top plate portion; a plurality of locking portions arranged in a circumferential direction in the skirt portion, the locking portions protruding inward in a radial direction of the skirt portion and supporting the sealing member; a plurality of small diameter portions arranged between the top plate portion and the locking portions of the skirt portion, the small diameter portions being respectively provided on a top plate portion side of the locking portions in the axial direction; and a plurality of large diameter portions provided adjacent to the small diameter portions in the circumferential direction and having an inscribed circle diameter larger than an inscribed circle diameter of the plurality of small diameter portions.

According to one aspect of the present invention, a method for producing a cap includes: arranging a molded product having a top plate portion and a skirt portion integrally formed with the top plate portion via an annular and curved corner portion in a first tool having a plurality of first protrusions on an outer peripheral surface thereof, a plurality of large-diameter-portion forming portions adjacent to the first protrusions in an axial direction, and small-diameter-portion forming portions adjacent to the large-diameter-portion forming portions in a circumferential direction; and forming a plurality of recessed portions, a plurality of small diameter portions, and a plurality of large diameter portions in the skirt portion by relatively rotating the first tool and a second tool having second protrusions arranged between the adjacent first protrusions of the first tool and causing the second protrusions to enter between the adjacent first protrusions.

Hereinafter, a cap 1 according to an embodiment of the present invention, a method for manufacturing the cap 1, and a manufacturing apparatus 200 for the cap 1 will be described with reference to FIGS. 1 to 16.

Figure 1:
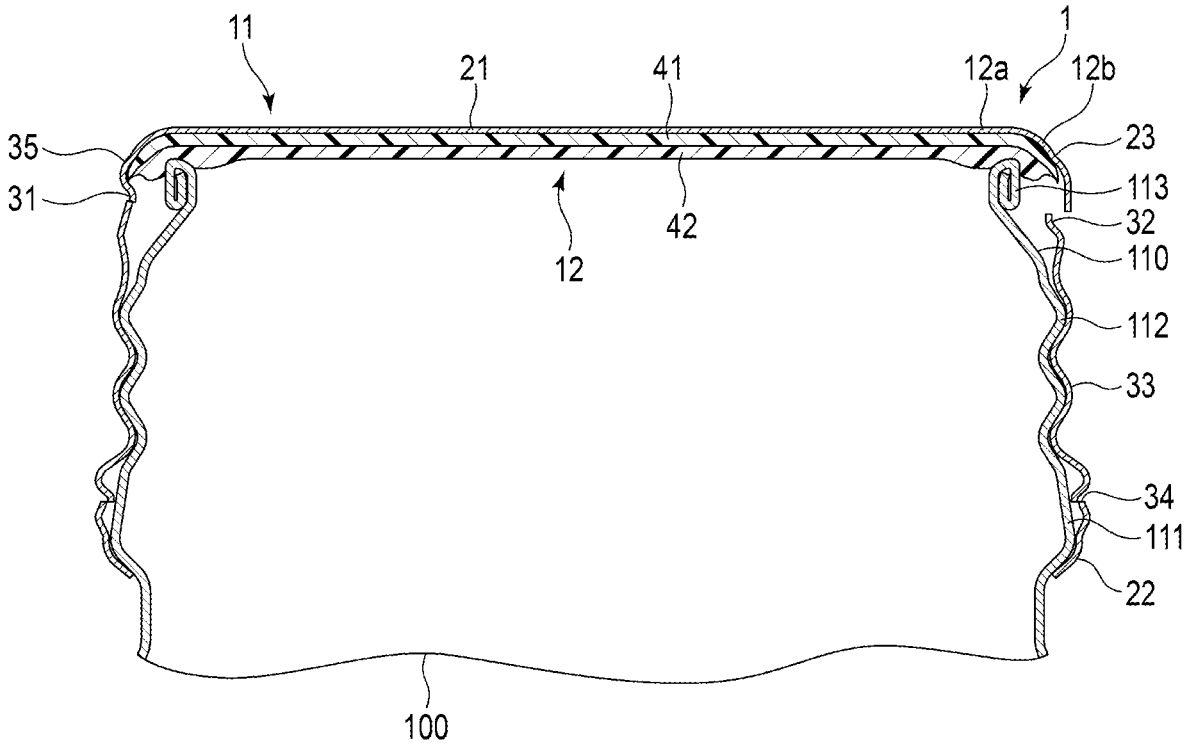
FIG. 1 is a cross-sectional view schematically showing a configuration of a cap and a can container according to an embodiment of the present invention.
Figure 2:
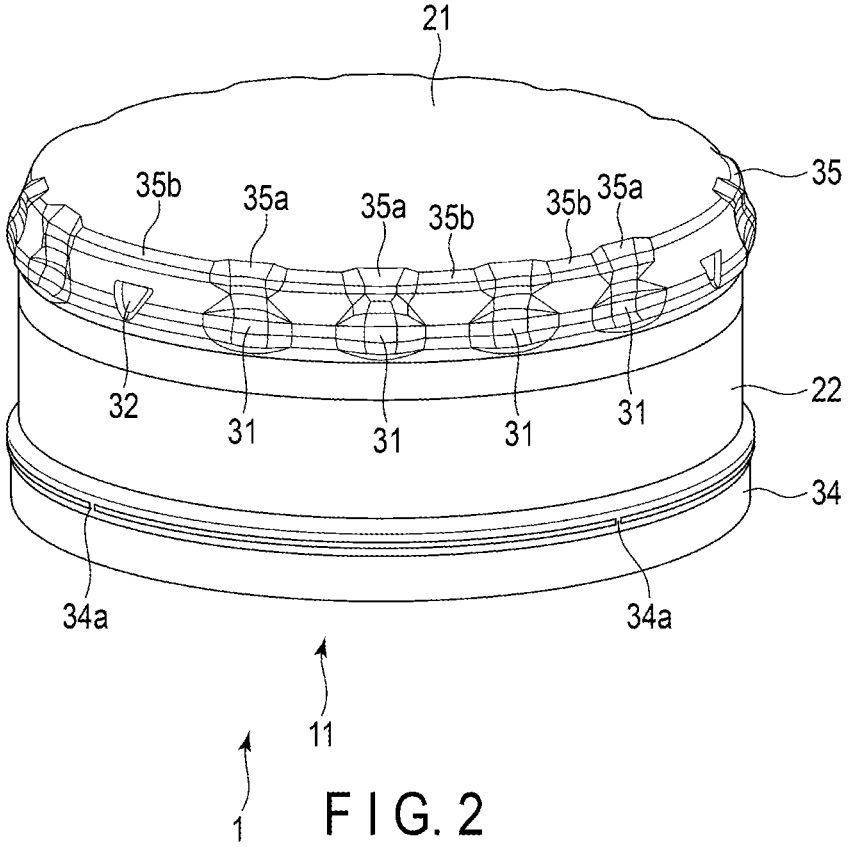
FIG. 2 is a perspective view showing a configuration of the cap.
Figure 3:
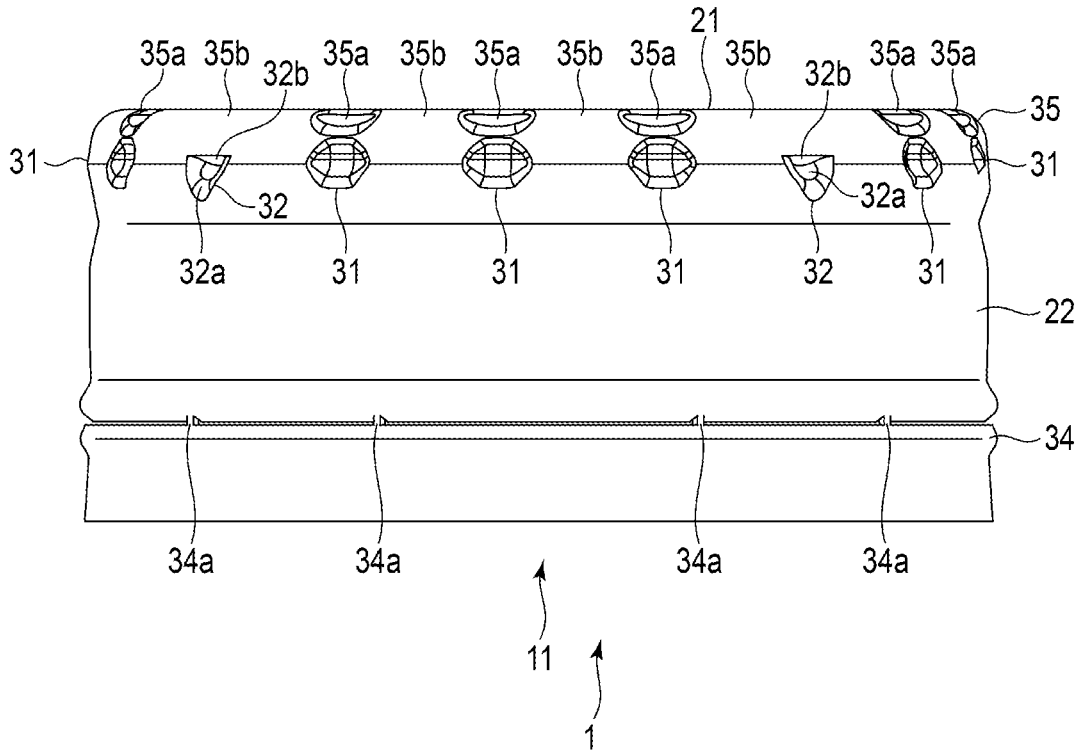
FIG. 3 is a side view showing the configuration of the cap.
Figure 4:
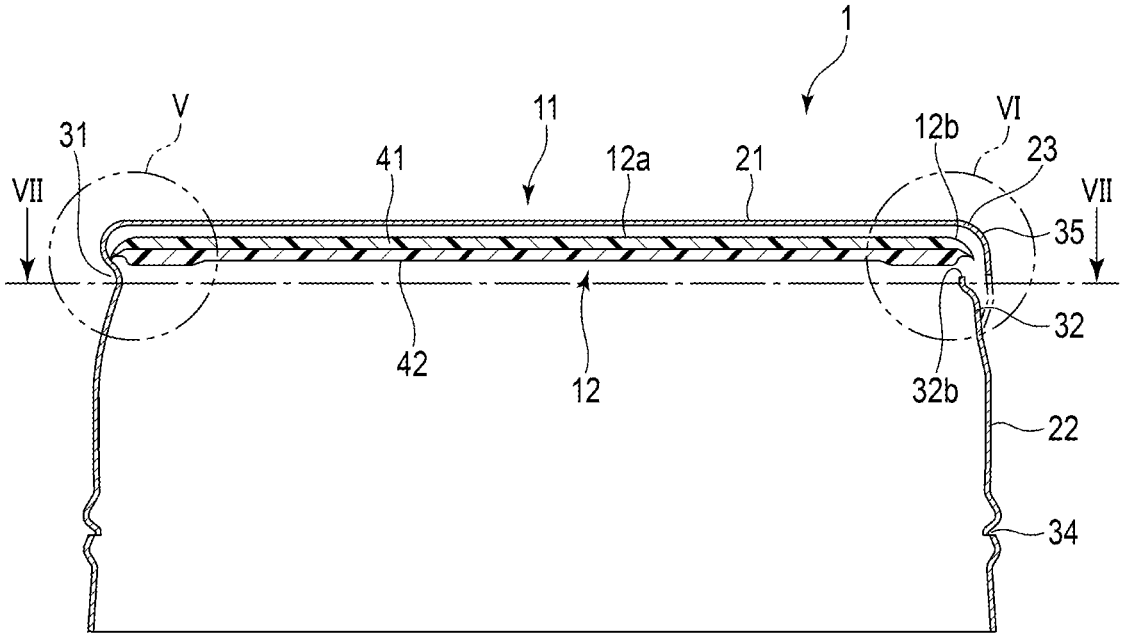
FIG. 4 is a cross-sectional view showing the configuration of the cap.
Figure 5:
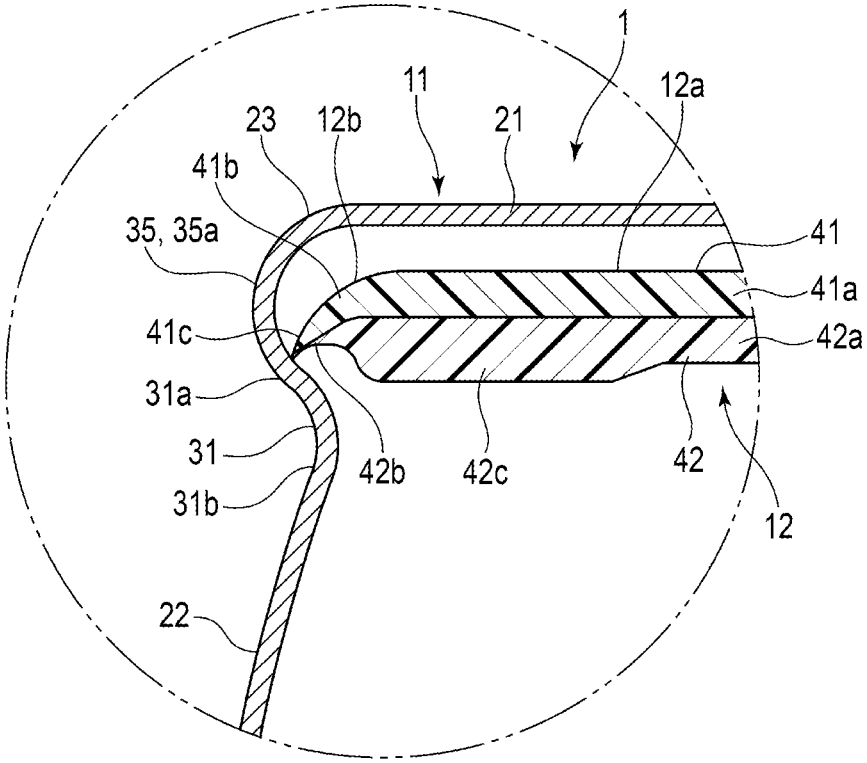
FIG. 5 is an enlarged cross-sectional view showing the configuration of the cap.
Figure 6:
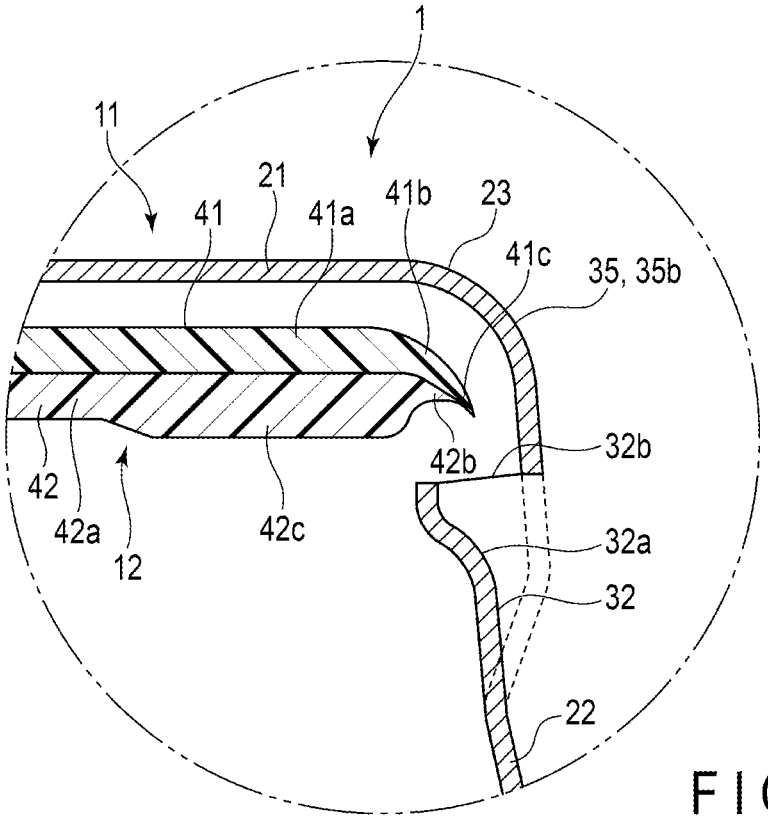
FIG. 6 is an enlarged cross-sectional view showing the configuration of the cap.
Figure 7:
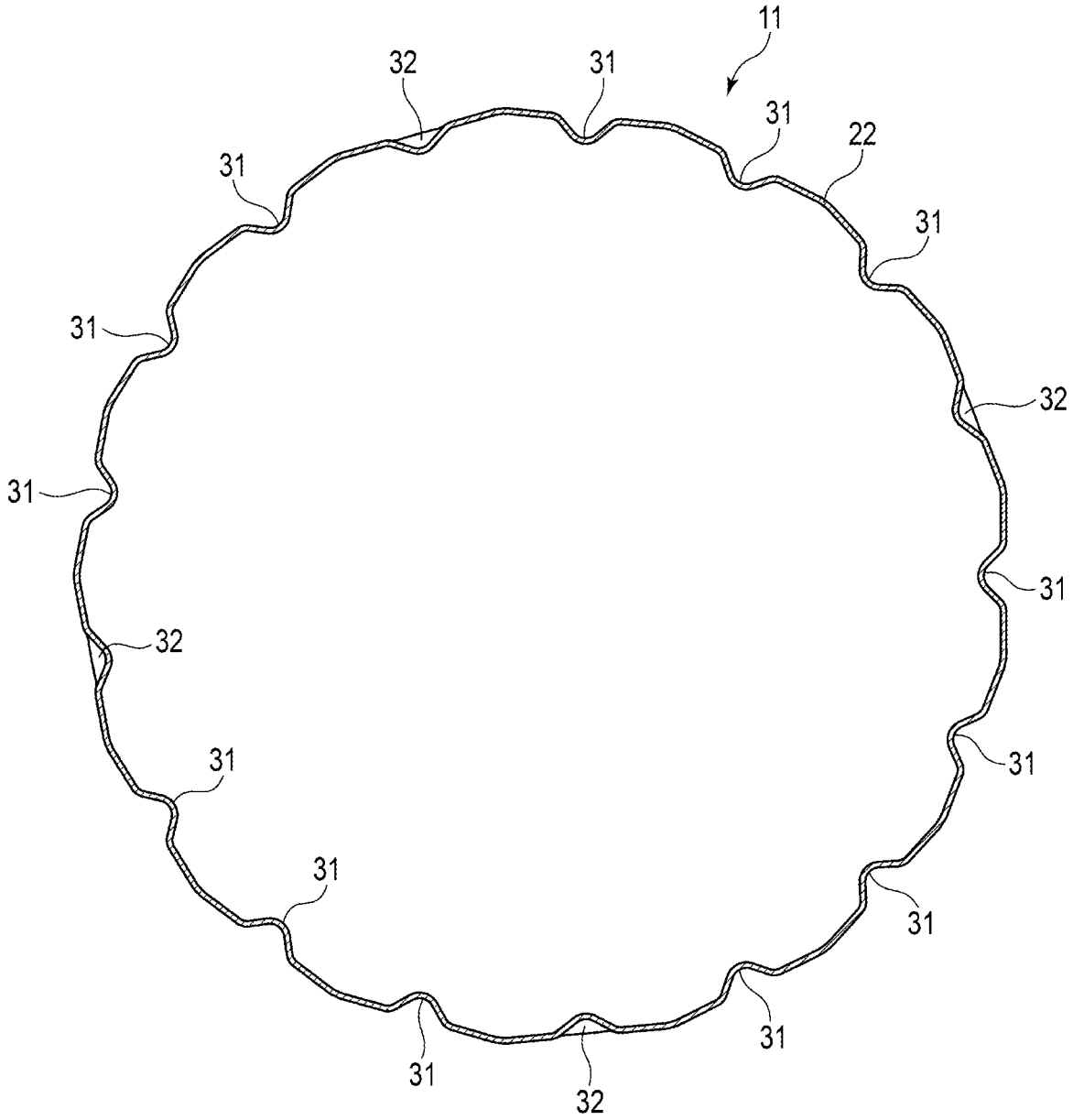
FIG. 7 is a cross-sectional view showing the configuration of the cap.

FIG. 1 is a cross-sectional view schematically showing a configuration of the cap 1 and a can container 100 according to the embodiment of the present invention, FIG. 2 is a perspective view showing the configuration of the cap 1, FIG. 3 is a side view showing the configuration of the cap 1, and FIG. 4 is a cross-sectional view showing the configuration of the cap 1. FIG. 5 is an enlarged cross-sectional view of a portion V in FIG. 4 showing the configuration of the cap 1, and FIG. 6 is an enlarged cross-sectional view of a portion VI in FIG. 4 showing the configuration of the cap 1. FIG. 7 is a cross-sectional view showing the configuration of the cap 1 taken along line VII-VII in FIG. 4.

Figure 8:
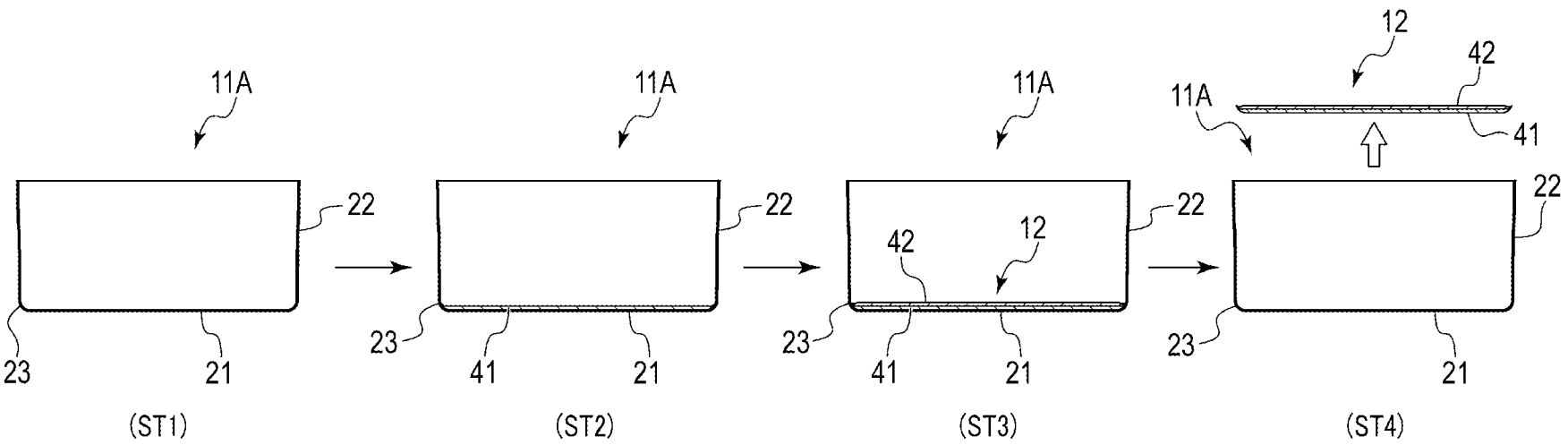
FIG. 8 is an explanatory view showing an example of a method for manufacturing the cap.
Figure 9:
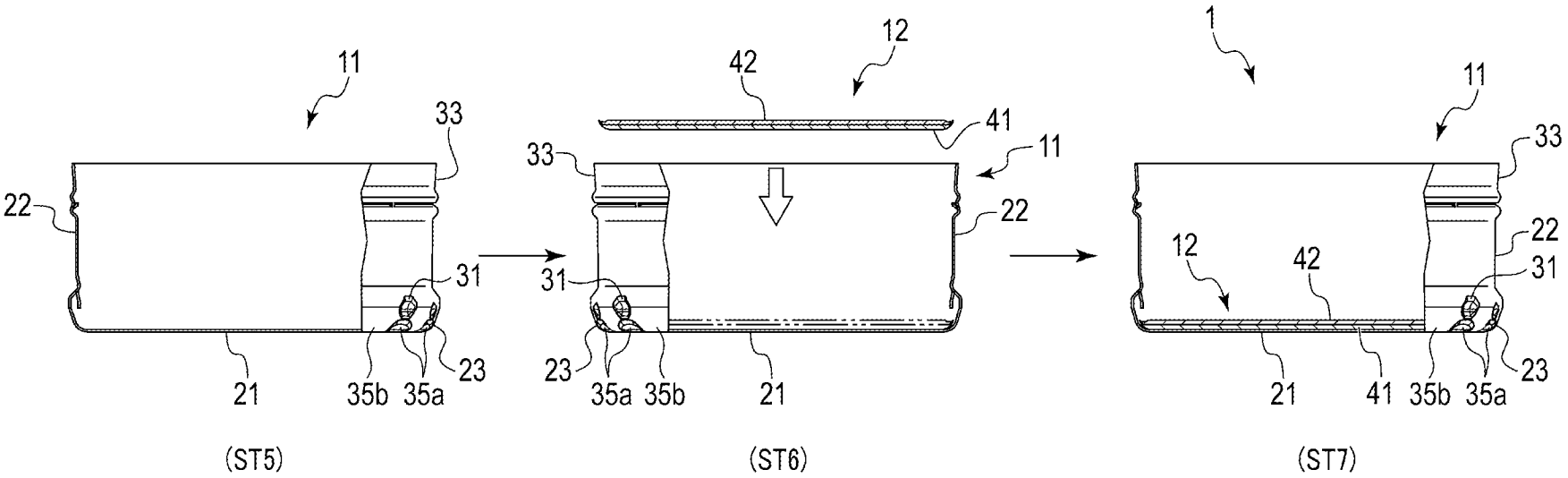
FIG. 9 is an explanatory view showing an example of the method for manufacturing the cap.
Figure 10:
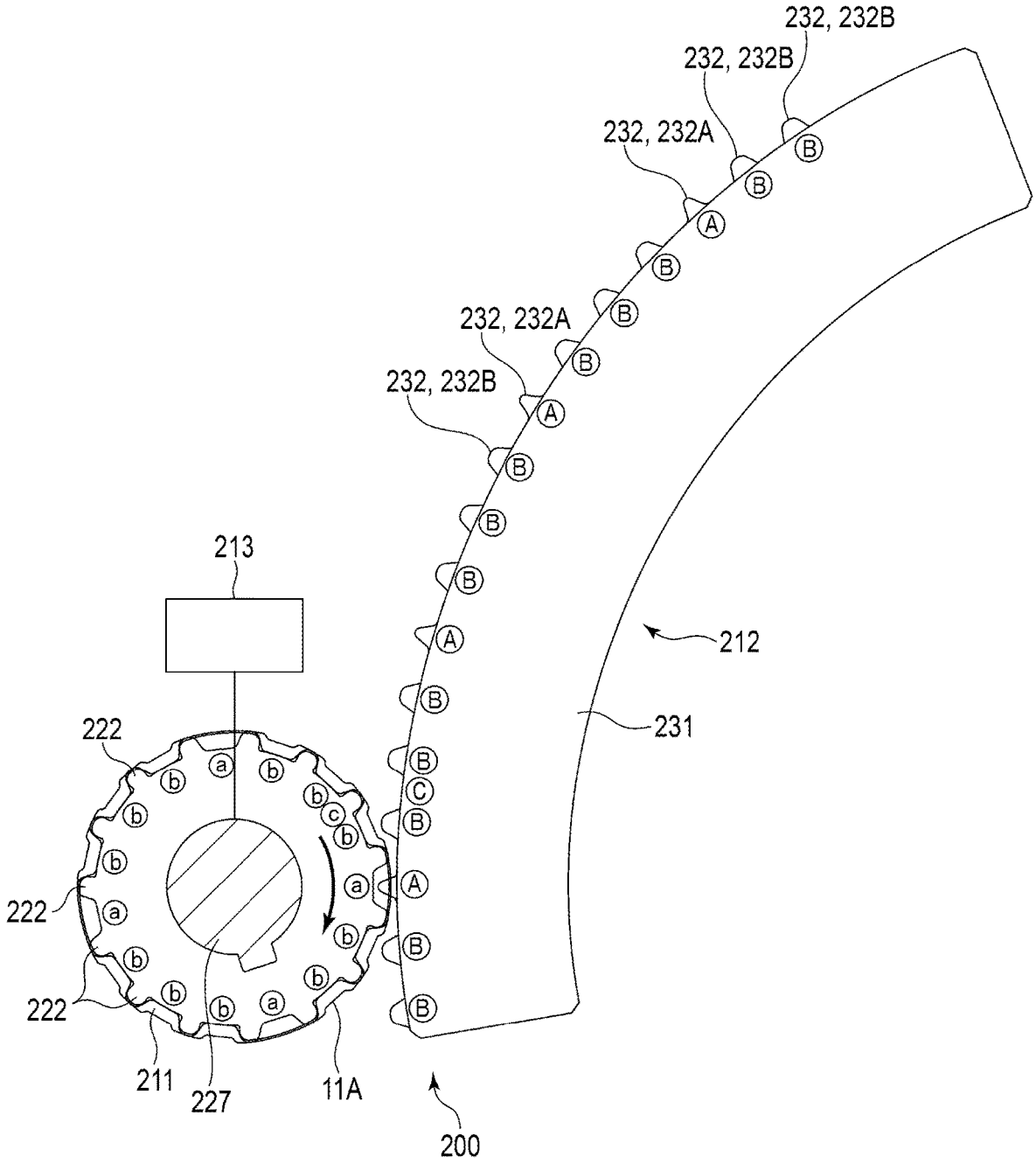
FIG. 10 is an explanatory view showing an example of a manufacturing apparatus for the cap.
Figure 11:
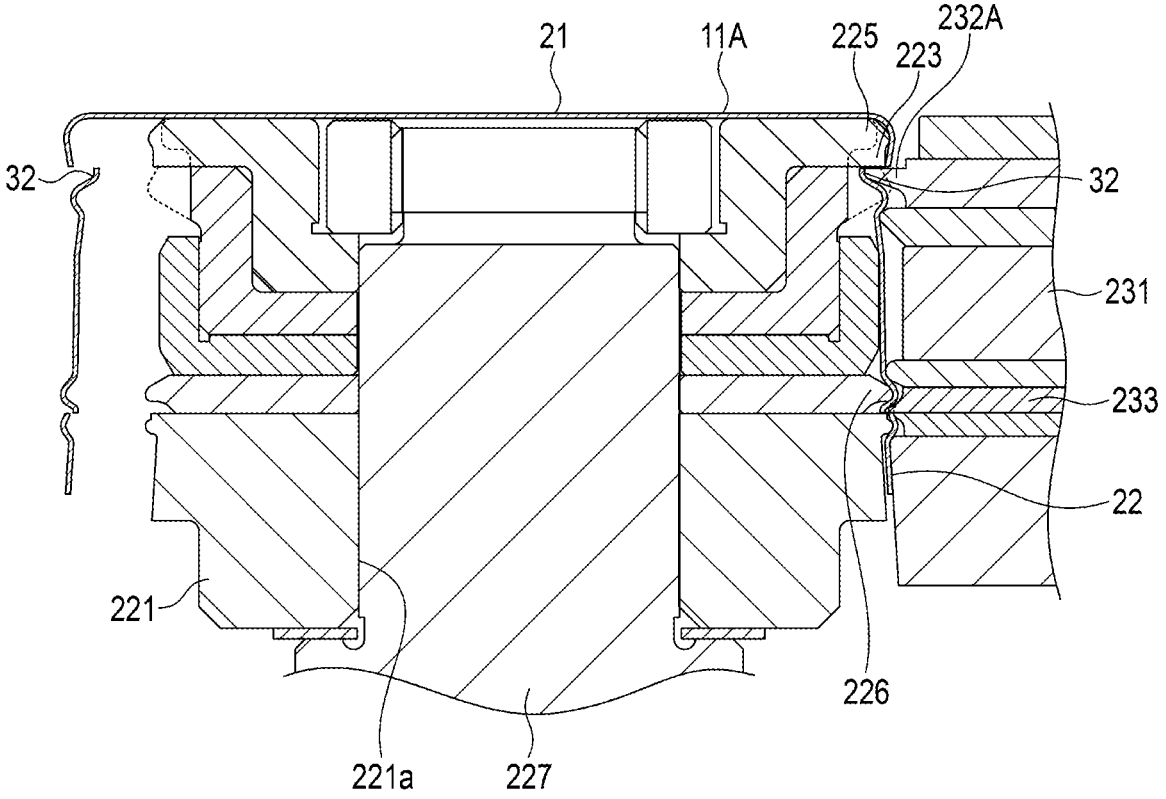
FIG. 11 is a cross-sectional view showing an example of the manufacturing apparatus for the cap.
Figure 12:
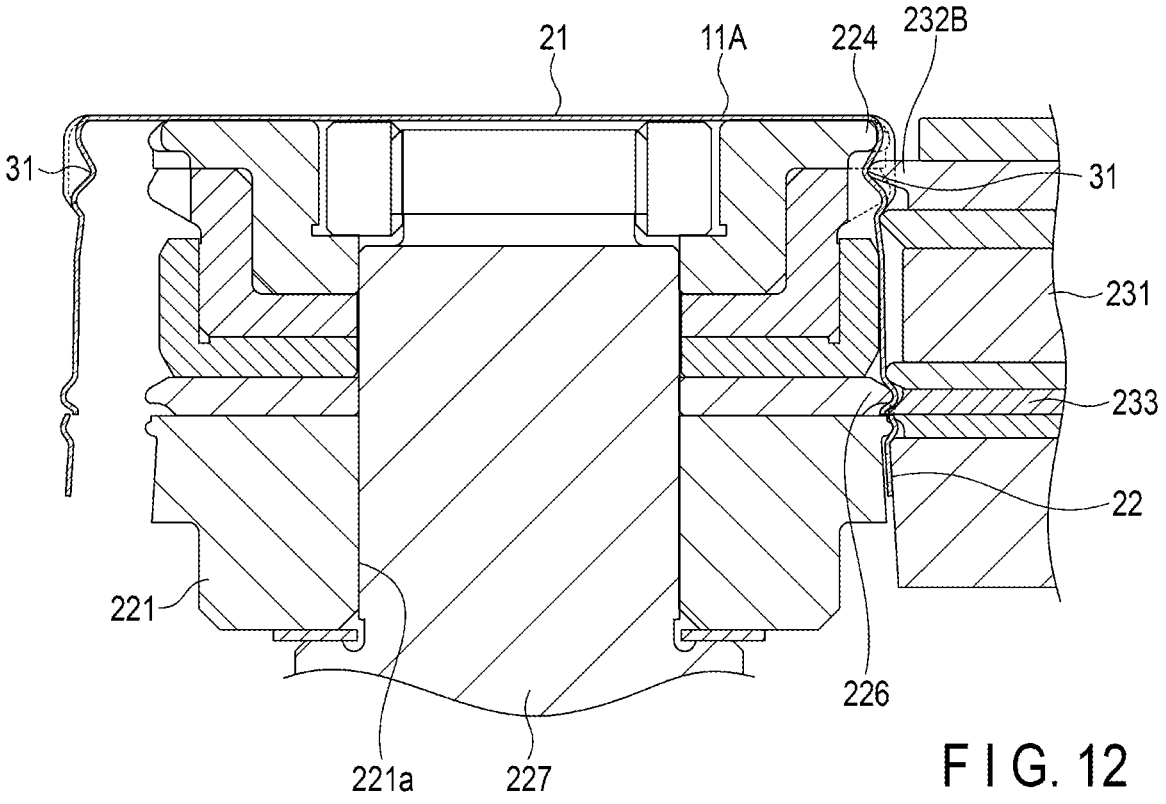
FIG. 12 is a cross-sectional view showing an example of the manufacturing apparatus for the cap.
Figure 13:
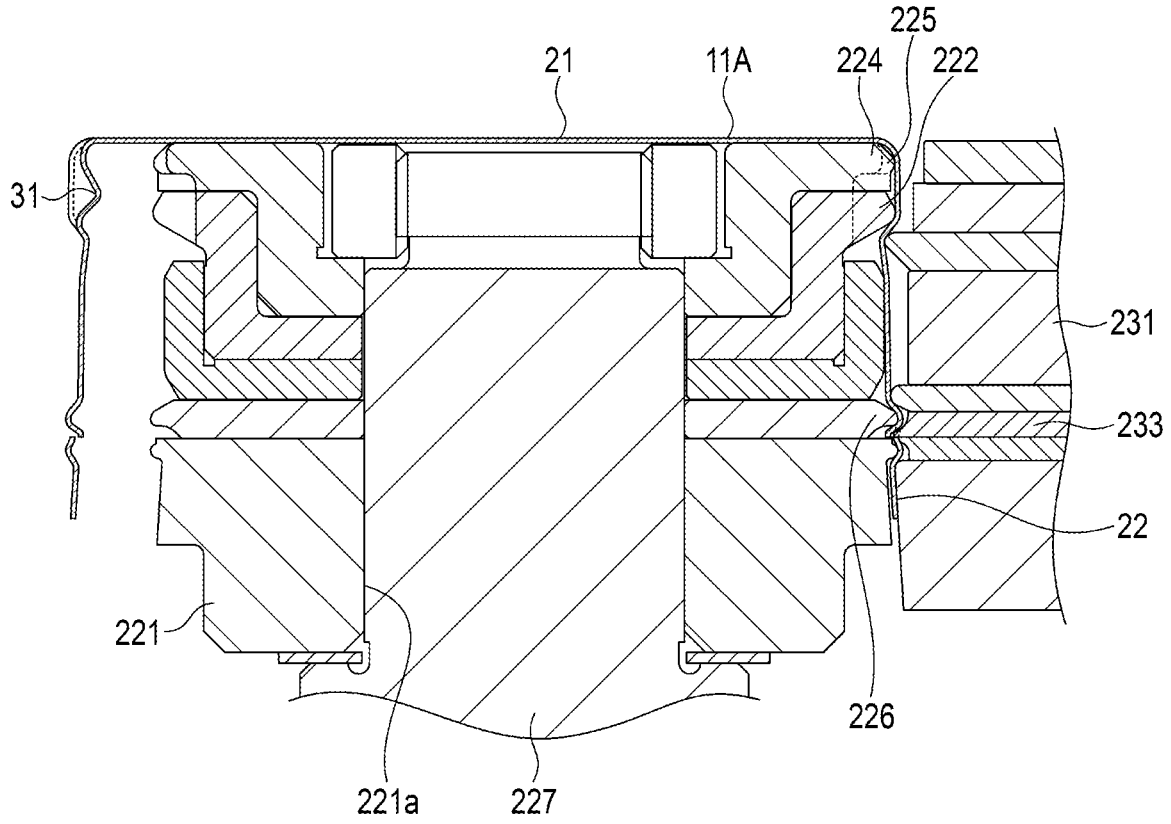
FIG. 13 is a cross-sectional view showing an example of the manufacturing apparatus for the cap.
Figure 14:
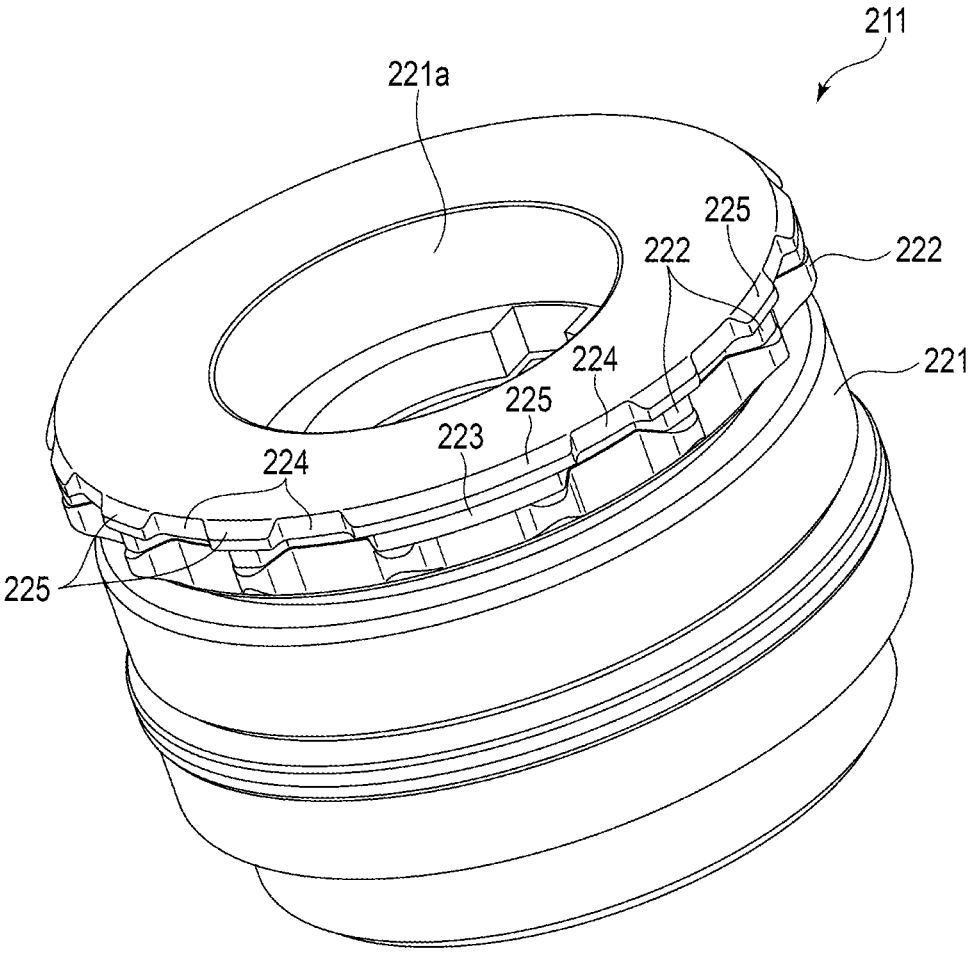
FIG. 14 is a perspective view showing a configuration of a first tool of the manufacturing apparatus.
Figure 15:
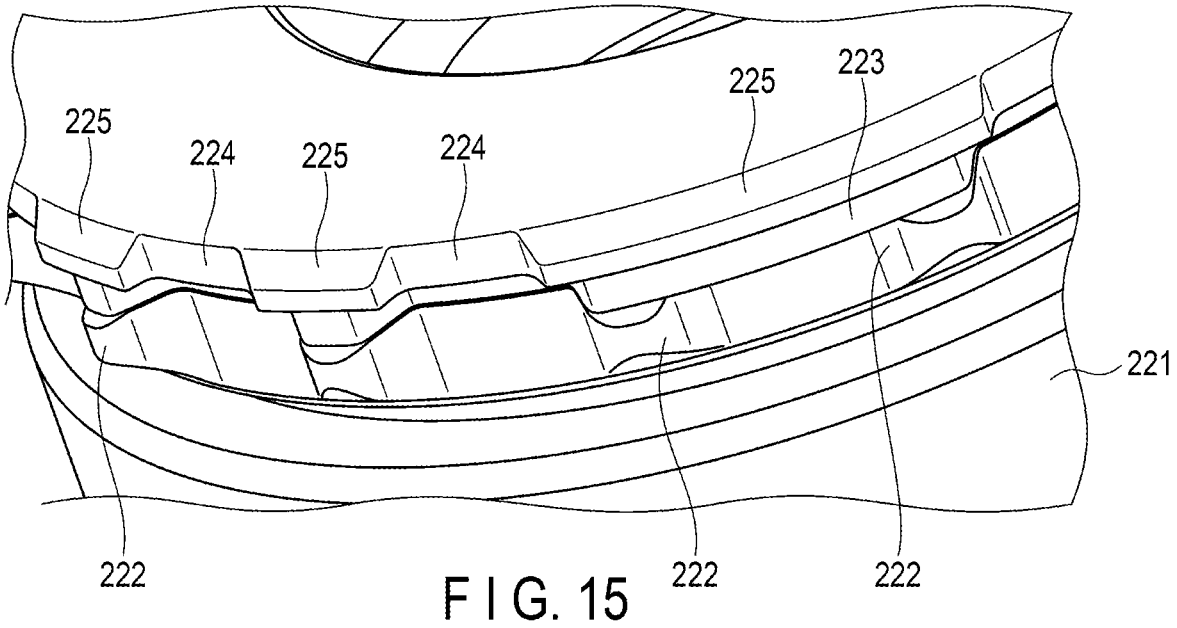
FIG. 15 is an enlarged perspective view showing the configuration of the first tool.
Figure 16:
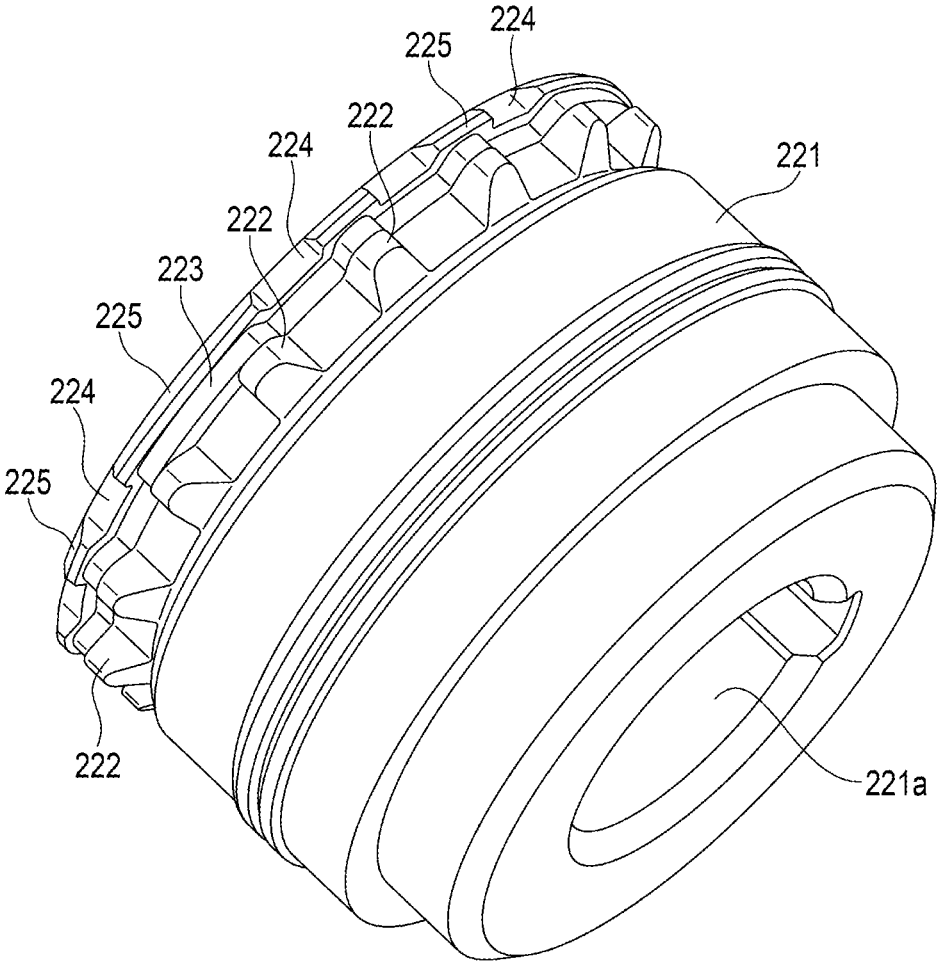
FIG. 16 is a perspective view showing the configuration of the first tool.

FIGS. 8 and 9 are explanatory views showing an example of a method for manufacturing the cap 1. FIG. 10 is an explanatory view showing a configuration of an example of the manufacturing apparatus 200 for the cap 1, and FIGS. 11 to 13 are cross-sectional views showing the example of the manufacturing apparatus 200 at different positions. FIG. 14 is a perspective view showing a configuration of a first tool 211 used in the manufacturing apparatus 200, and FIG. 15 is an enlarged perspective view showing the configuration of the first tool 211 in the same posture as in FIG. 11. FIG. 16 is a perspective view showing the configuration of the first tool 211 in a posture different from that in FIG. 11.

As shown in FIG. 1, the cap 1 is wound and compacted in a state of covering a mouth portion 110 of the can container 100, thereby hermetically sealing the mouth portion 110. First, the can container 100 will be described with reference to FIG. 1.

As shown in FIG. 1, the can container 100 is a so-called bottle-type container used for containing a beverage or the like. For example, the can container 100 is made of a metal material such as an aluminum alloy or a surface-treated steel plate having resin films laminated on both surfaces thereof. The can container 100 is formed in a cylindrical shape having a varied outer diameter which is smaller at one end. The can container 100 has a mouth portion 110 at the one end for discharging the contained beverage. The mouth portion 110 has a jaw portion 111, a male screw portion 112, and a curl portion 113 on the outer peripheral surface thereof from the bottom surface side of the can container 100 toward the end portion.

The jaw portion 111 is configured to protrude annularly. The curl portion 113 is formed to have a smaller diameter than the male screw portion 112. The curl portion 113 is configured to be smaller than the inner diameter of the cap 1. The curl portion 113 is formed by folding the end portion of the mouth portion 110 once or more. The curl portion 113 forms an opening through which the beverage contained in the can container 100 is discharged.

As shown in FIGS. 1 to 6, the cap 1 includes a cap body 11 and a sealing member 12 provided separately in the cap body 11.

The cap body 11 is made of a material obtained by forming a resin coating layer on a metal material such as an aluminum alloy. The cap body 11 is formed into a cup shape by drawing, knurling, roll-on molding, press molding or the like of the material in the form of a thin flat plate.

As shown in FIGS. 1 to 4, the cap body 11 includes a disk-shaped top plate portion 21 and a cylindrical skirt portion 22 extending downward from a peripheral edge portion of the top plate portion 21. In the cap body 11, the top plate portion 21 and the skirt portion 22 are integrally and continuously formed by an annular and curved corner portion 23.

The top plate portion 21 is formed in a disk shape. As shown in FIGS. 1 and 4, the top plate portion 21 has a main surface formed in a planar shape. At least one of embossing and debossing may be performed on a part of the top plate portion 21.

One end of the skirt portion 22 is continuous with the top plate portion 21 via the corner portion 23, and the other end is open. As shown in FIGS. 1 to 4, the skirt portion 22 includes a plurality of locking portions 31, a plurality of vent slit portions 32, a female screw portion 33, a tamper evidence band portion 34, and an upper annular portion 35. In the skirt portion 22, for example, the upper annular portion 35, the plurality of locking portions 31, the plurality of vent slit portions 32, the female screw portion 33, and the tamper evidence band portion 34 are sequentially formed between the end portion on the top plate portion 21 side and the open end portion.

A cup-shaped molded product 11A composed of the top plate portion 21, the cylindrical skirt portion 22 where the plurality of locking portions 31, the plurality of vent slit portions 32, the female screw portion 33, and the tamper evidence band portion 34 are not formed, and the corner portion 23 is subjected to processing such as knurling molding or roll-on molding to form the plurality of locking portions 31, the plurality of vent slit portions 32, the female screw portion 33, and the tamper evidence band portion 34 in the skirt part 22. The female screw portion 33 is formed in a state in which the cap 1 is attached to the can container 100.

The plurality of locking portions 31 restrict movement of the sealing member 12 and hold the sealing member 12 by the skirt portion 22 being recessed inward in the radial direction. The locking portion 31 is a recessed portion in which a slit penetrating the skirt portion 22 is not formed. As shown in FIG. 5, the locking portion 31 has an upper inclined surface 31*a* which is inclined inward in the radial direction of the cap 1 and downward from the upper annular portion 35 in a longitudinal section, and a lower inclined surface 31*b* which is inclined inward in the radial direction of the cap 1 and upward from the skirt portion 22 below the locking portion 31 in a longitudinal section. The plurality of locking portions 31 restrict the movement of the sealing member 12 and hold the sealing member 12 by locking the sealing member 12 to inner surfaces of the plurality of upper inclined surfaces 31*a*.

As shown in FIG. 6, the vent slit portion 32 includes a recessed portion 32*a* and a vent slit 32*b* formed in a part of the recessed portion 32*a*. The vent slit portion 32 protrudes from an inner peripheral surface of the skirt portion 22. The vent slit 32*b* is a cut through which gas in the can container 100 is discharged at the time of opening.

For example, in the present embodiment, thirteen locking portions 31 are provided and four vent slit portions 32 are formed along the circumferential direction of the skirt portion 22. The plurality of vent slit portions 32 are set at equal or substantially equal intervals in the circumferential direction of the skirt portion 22, and the plurality of locking portions 31 and the plurality of vent slit portions 32 are set at equal or substantially equal intervals in the circumferential direction of the skirt portion 22. The plurality of locking portions 31 are provided on the top plate portion 21 side (upper annular portion 35 side) in the axial direction of the skirt portion 22 with respect to the plurality of vent slit portions 32.

The female screw portion 33 is configured to be screwed with the male screw portion 112 of the can container 100. The female screw portion 33 is formed together with the can container 100. That is, the female screw portion 33 is not formed in a finished product of the cap 1 before being attached to the can container 100, but is formed when the cap 1 is integrally combined with the can container 100.

The tamper evidence band portion 34 engages with the jaw portion 111 of the can container 100 in a direction in which the cap 1 moves away from the can container 100 and in an axial direction of the cap 1. In addition, the tamper evidence band portion 34 has a breaking portion 34*a*, which is broken and detached from the skirt portion 22 when the cap 1 is opened. That is, the tamper evidence band portion 34 is configured by forming a slit on the end portion side of the skirt portion 22 while leaving the breaking portion 34*a*, and is formed into the shape of the jaw portion 111 of the can container 100 when integrally combined with the can container 100, thereby engaging with the jaw portion 111, in a manner similar to the female screw portion 33.

The upper annular portion 35 is formed at a portion located between the top plate portion 21 and the plurality of locking portions 31 of the skirt portion 22. For example, the upper annular portion 35 is formed in a part of the corner portion 23. The upper annular portion 35 has a plurality of small diameter portions 35*a* and a plurality of large diameter portions 35*b* in the circumferential direction thereof. The inscribed circle diameter (inner diameter) of the plurality of small diameter portions 35*a* is relatively smaller than the inscribed circle diameter (inner diameter) of the plurality of large diameter portions 35*b*.

The small diameter portion 35*a* is adjacent to the locking portion 31 in the axial direction of the cap 1. The inscribed circle diameter (inner diameter) of the plurality of small diameter portions 35*a* is set to be smaller than the outer diameter of the sealing member 12, and the inscribed circle diameter (inner diameter) of the plurality of large diameter portions 35*b* is set to be larger than the outer diameter of the sealing member 12.

In the upper annular portion 35 described above, when the plurality of locking portions 31 are formed, the plurality of small diameter portions 35*a* are formed by recessing portions of the upper annular portion 35 adjacent to the upper portions of the respective locking portions 31 inward in the radial direction. In the upper annular portion 35, portions where the plurality of small diameter portions 35*a* are not formed, that is, portions between the plurality of small diameter portions 35*a* in the circumferential direction, respectively constitute the plurality of large diameter portions 35*b*.

In the present embodiment, the plurality of vent slit portions 32 are set at equal or substantially equal intervals in the circumferential direction of the skirt portion 22, and the plurality of locking portions 31 and the plurality of vent slit portions 32 are set at equal or substantially equal intervals in the circumferential direction of the skirt portion 22. Therefore, the circumferential length of the large diameter portion 35*b* corresponding to the portion where the two locking portions 31 are adjacent in the circumferential direction of the skirt portion 22 is shorter than the circumferential length of the large diameter portion 35*b* corresponding to the portion where the two locking portions 31 between which the vent slit portion 32 is disposed are adjacent in the circumferential direction of the skirt portion 22.

As shown in FIG. 4, the sealing member 12 is formed separately from the cap body 11. The sealing member 12 has a disk shape having an outer diameter larger than the inscribed circle diameter of the plurality of locking portions 31 provided in the skirt portion 22 of the cap body 11 and the inscribed circle diameter of the plurality of small diameter portions 35*a*. The sealing member 12 is provided integrally with the cap body 11 by being engaged in the axial direction of the cap body 11 with the upper inclined surfaces 31*a* of the locking portions 31 protruding in the radial direction from the inner peripheral surface of the skirt portion 22.

As shown in FIGS. 1 and 4 to 6, the sealing member 12 includes a disk-shaped sliding layer 41 and a disk-shaped sealing layer 42 integrally laminated on the sliding layer 41. In the sealing member 12, the sliding layer 41 and the sealing layer 42 are formed of different synthetic resins. In the sealing member 12, the sealing layer 42 is integrally laminated on the sliding layer 41.

For example, as illustrated in FIG. 1, the sealing member 12 includes a flat plate portion 12*a* in which a region in contact with the mouth portion 110 on the outer peripheral side is formed to be thicker than the central side, and a curved surface portion 12*b* in which the outer surface of the outer peripheral edge on the top plate portion 21 side is a curved surface. In other words, the sealing member 12 is formed in a disk shape, and a ridge portion on the top plate portion 21 side is configured by a curved surface having a predetermined curvature. The sealing member 12 may have, for example, a configuration in which the flat plate portion 12*a* has a uniform thickness.

The sliding layer 41 is made of a resin material having a relatively higher hardness (harder) than the sealing layer 42. The sliding layer 41 is made of a resin material having neither adhesiveness nor stickiness to the resin coating layer of the cap body 11. That is, the sliding layer 41 is not bonded to the top plate portion 21 and slides on the top plate portion 21 in a state of being in contact with the top plate portion 21.

Examples of the resin material used for the sliding layer 41 include olefin-based resins such as polypropylene resin and polyethylene resin, polyester-based resins such as polyethylene terephthalate, styrene-based resins, and acrylic-based resins. In the present embodiment, the sliding layer 41 is made of, for example, polypropylene resin. A pigment, a lubricant, a softener, and the like can be appropriately added to the resin material used for the sliding layer 41. In the example of the present embodiment, the hardness of the sliding layer 41 is D10 to D70 in terms of the durometer D hardness according to JIS K7215.

As shown in FIGS. 1 and 4 to 6, the sliding layer 41 is provided separately from the cap body 11 so as to face the top plate portion 21 of the cap body 11. The sliding layer 41 is configured to be slidable with the top plate portion 21 of the cap body 11 due to the resin material that is used. The sliding layer 41 is formed in a disk shape. The outer diameter of the sliding layer 41 is smaller than the inner diameter of the skirt portion 22. The outer diameter of the sliding layer 41 is larger than the inscribed circle diameter of the plurality of locking portions 31 and the inscribed circle diameter of the plurality of small diameter portions 35*a*, and is smaller than the inscribed circle diameter of the plurality of large diameter portions 35*b*. The outer diameter of the sliding layer 41 is configured to be larger than the outer diameter of the curl portion 113 of the mouth portion 110.

As illustrated in FIGS. 5 and 6, the sliding layer 41 includes, for example, a first flat plate portion 41*a* having a uniform thickness and a first curved surface portion 41*b* in which an outer surface of an outer peripheral edge on the top plate portion 21 side is configured by a curved surface. In addition, for example, the sliding layer 41 includes a protruding portion 41*c* provided on the sealing layer 42 side of the first curved surface portion 41*b*. The first flat plate portion 41*a* is configured to have a uniform thickness from the center of the sliding layer 41 to the outer peripheral side of the portion of the mouth portion 110 facing the curl portion 113.

The first curved surface portion 41*b* is configured such that the portion from the outer peripheral side of the portion of the mouth portion 110 facing the curl portion 113 to the outer peripheral edge gradually decreases in thickness toward the outer peripheral edge. The protruding portion 41*c* is configured in an annular protruding shape that is inclined with respect to the axial direction of the sliding layer 41 and the surface direction of the top plate portion 21, and is curved or inclined toward the open end portion side of the skirt portion 22. The protruding portion 41*c* gradually decreases in thickness from the first curved surface portion 41*b* toward the distal end.

The sealing layer 42 is made of a resin material having a relatively lower hardness (softer) than the sliding layer 41. Examples of the resin material used for the sealing layer 42 include an olefin-based resin, a polyester-based resin, a styrene-based resin, an acrylic-based resin, and the like, and more preferably include a blended material of a styrene-based elastomer and a polypropylene resin, a blended material of low-density polyethylene and a styrene-based elastomer, a polyester-based elastomer, and the like. The resin material used for the sealing layer 42 has adhesion to the resin material used for the sliding layer 41. In the present embodiment, the sealing layer 42 is made of, for example, a blended material of a styrene-based elastomer and a polypropylene resin. A pigment, a lubricant, a softener, and the like can be appropriately added to the resin material used for the sealing layer 42.

As shown in FIGS. 1 and 4 to 6, the sealing layer 42 is integrally provided on the main surface of the sliding layer 41 on the side facing the mouth portion 110. The sealing layer 42 is formed in a disk shape. The outer diameter of the sealing layer 42 is smaller than the inner diameter of the skirt portion 22. The outer diameter of the sealing layer 42 is larger than the inscribed circle diameter of the plurality of locking portions 31 and the inscribed circle diameter of the plurality of small diameter portions 35*a*, and is smaller than the inscribed circle diameter of the plurality of large diameter portions 35*b*. The outer diameter of the sealing layer 42 is configured to be larger than the outer diameter of the curl portion 113 of the mouth portion 110. The outer diameter of the sealing layer 42 is set to, for example, the same as that of the outer diameter of the sliding layer 41.

As illustrated in FIGS. 5 and 6, the sealing layer 42 includes a second flat plate portion 42*a* having a uniform thickness, a second curved surface portion 42*b* in which an outer surface of an outer peripheral edge on the top plate portion 21 side is configured by a curved surface, and a thick portion 42*c* provided in the second flat plate portion 42*a*. A main surface of the second flat plate portion 42*a* facing the curl portion 113 is formed as a flat surface. For example, the second flat plate portion 42*a* has the same diameter as the first flat plate portion 41*a* of the sliding layer 41. The second flat plate portion 42*a* constitutes the flat plate portion 12*a* of the sealing member 12 together with the first flat plate portion 41*a*. In the present embodiment, the first flat plate portion 41*a* and the second flat plate portion 42*a* are set to have the same thicknesses, for example.

The second curved surface portion 42*b* has, for example, a main surface flush with the main surface of the second flat plate portion 42*a* facing the curl portion 113. The second curved surface portion 42*b* is configured such that the portion from the outer peripheral side of the portion of the mouth portion 110 facing the curl portion 113 to the outer peripheral edge gradually decreases in thickness toward the outer peripheral edge. The second curved surface portion 42*b* is laminated on the first curved surface portion 41*b* and the protruding portion 41*c*. The second curved surface portion 42*b* constitutes the curved surface portion 12*b* of the sealing member 12 together with the first curved surface portion 41*b* and the protruding portion 41*c*.

The thick portion 42*c* is an annular protrusion protruding from the main surface of the second flat plate portion 42*a* on the side opposite to the sliding layer 41. The thick portion 42*c* constitutes a sealing portion which abuts the mouth portion 110 of the can container 100. The sliding layer 41 may have a configuration in which a thin portion that is a recess is provided at a portion facing the thick portion 42*c*, with the thick portion 42*c* protruding annularly from both main surfaces of the second flat plate portion 42*a* so as to secure a collapse margin of the thick portion 42*c*.

The sliding layer 41 and the sealing layer 42 are configured such that the first curved surface portion 41*b*, the protruding portion 41*c*, and the second curved surface portion 42*b* are each thinner than the first flat plate portion 41*a* and the second flat plate portion 42*a*.

Next, a method for manufacturing the cap 1 configured as described above will be described with reference to FIGS. 8 and 9.

First, a sheet-like metallic material is drawn by a shell press apparatus to form a molded product 11A (step ST1). Next, the sliding layer 41 is molded on the top plate portion 21 of the molded product 11A by a sliding layer forming apparatus (step ST2).

Next, the sealing layer 42 is molded on the sliding layer 41 in the molded product 11A by a sealing layer forming apparatus (step ST3). Thus, the sealing member 12 is molded in the molded product 11A.

Next, the sealing member 12 in the molded product 11A is removed by a sealing member conveying apparatus (step ST4). Next, the plurality of locking portions 31, the plurality of vent slit portions 32, the tamper evidence band portion 34, and the upper annular portion 35 are formed by a molded product processing apparatus in the molded product 11A from which the sealing member 12 has been removed (step ST5).

Next, the sealing member 12 is inserted by the sealing member conveying apparatus into the molded product 11A in which the plurality of locking portions 31, the plurality of vent slit portions 32, the tamper evidence band portion 34, and the upper annular portion 35 are molded (step ST6). Through these steps, the cap 1 is manufactured (step ST7).

For example, the manufactured cap 1 is collected in a collection unit. When a certain number of caps 1 are collected, they are conveyed to a next step, i.e., an inspection and packaging step, where they are subjected to quality inspection and packaging.

Next, a method for capping the mouth portion 110 of the can container 100 with the manufactured cap 1 will be described. For example, the cap 1 is put on the mouth portion 110 of the can container 100 so that the curl portion 113, which is the distal end portion of the mouth portion 110 of the can container 100, is in contact with the sealing layer 42 of the sealing member 12. In this state, a load is applied to the top plate portion 21 of the cap body 11, and the skirt portion 22 is roll-on molded while the corner portion 23 is drawn downward (toward the can container 100). As a result, as shown in FIG. 1, the female screw portion 33 is formed in the skirt portion 22 of the cap 1, and the cap 1 is wound and compacted to the mouth portion 110 of the can container 100. Such a capping method is performed in a state where the can container 100 is filled with the beverage. In addition, for example, the can container 100 capped with the cap 1 is subjected to retort treatment depending on the content.

Next, an example of a configuration of the manufacturing apparatus 200 which is used in the molded product processing apparatus and molds the plurality of locking portions 31, the plurality of vent slit portions 32, and the upper annular portion 35 of the cap 1 in the aforementioned step ST5 will be described with reference to FIGS. 10 to 16.

In FIGS. 11 to 13, in order to explain the combination of the first tool 211 and the second tool 212 at each position, FIG. 10 shows a, b, and c that define the positions in the tool 211 and A, B, and C that define the positions in the tool 212. FIG. 11 shows a cross section taken along a line at a combination a-A of the tools 211 and 212, FIG. 12 shows a cross section taken along a line at a combination b-B of the tools 211 and 212, and FIG. 13 shows a cross section taken along a line at a combination c-C of the tools 211 and 212.

As shown in FIGS. 10 to 16, the manufacturing apparatus 200 includes the first tool 211, the second tool 212, and a driving device 213. The manufacturing apparatus 200 is an apparatus that forms the plurality of locking portions 31, the plurality of vent slit portions 32, the tamper evidence band portion 34, the plurality of small diameter portions 35*a*, and the plurality of large diameter portions 35*b* in the skirt portion 22 by performing knurling on the skirt portion 22 of the cap body 11 (the molded product 11A). For example, the manufacturing apparatus 200 relatively rotates the first tool 211 and the second tool 212 by the driving device 213 to form a portion of the skirt portion 22 located between the first tool 211 and the second tool 212.

As illustrated in FIGS. 10 to 16, the first tool 211 includes a first base portion 221, a plurality of first protrusions 222, a plurality of cutter portions 223, a plurality of small-diameter-portion forming portions 224, a plurality of large-diameter-portion forming portions 225, a first tamper-evidence-band-portion forming portion 226 provided on the first base portion 221, and a rotary shaft 227 provided in the first base portion 221. In the first tool 211, the first base portion 221 and the plurality of first protrusions 222 are disposed in the cap body 11. The first tool 211 is configured by combining a plurality of components.

The first base portion 221 is disposed in the skirt portion 22 of the cap body 11. The first base portion 221 has a cylindrical shape having an outer diameter smaller than the inner diameter of the skirt portion 22. The first base portion 221 has, for example, a hole 221*a* into which the rotary shaft 227 is inserted. The hole 221*a* has, for example, a key groove.

The first protrusion 222 has, for example, a semi-cylindrical shape whose axial direction is along the axial direction of the first base portion 221 or a triangular prism shape in which both side portions are curved. The plurality of first protrusions 222 are arranged in the circumferential direction with a predetermined distance between the adjacent first protrusions 222. Here, the predetermined distance is set to a width larger than a circumferential width of a second protrusion 232 of the second tool 212, which will be described later.

The cutter portion 223 is a protrusion that shears, breaks, or cuts a portion of the skirt portion 22 where the vent slit 32*b* is formed, together with the second protrusion 232 of the second tool 212. The cutter portion 223 is arranged between adjacent first protrusions 222 among the plurality of first protrusions 222 on one end side of each of the adjacent first protrusions 222.

The small-diameter-portion forming portion 224 is a recess provided adjacent to the end portion side of the first protrusion 222 of the first base portion 221 in the axial direction. The large-diameter-portion forming portion 225 is a protrusion formed adjacent to the small-diameter-portion forming portion 224 in the circumferential direction. The large-diameter-portion forming portion 225 is provided in a range adjacent to the cutter portion 223 in the axial direction. The plurality of small-diameter-portion forming portions 224 and the plurality of large-diameter-portion forming portions 225 are recesses and protrusions provided in the circumferential direction at the end portion of the first base portion 221.

The first tamper-evidence-band-portion forming portion 226 forms the skirt portion 22 in the shape of the tamper evidence band portion 34 and forms a plurality of breaking portions 34*a* by intermittently forming slits.

The rotary shaft 227 is fixed to the hole 221*a* of the first base portion 221. The rotary shaft 227 is connected to the driving device 213.

The second tool 212 is a tool that is disposed on the outer peripheral surface side of the skirt portion 22 and forms the plurality of locking portions 31, the plurality of vent slit portions 32, the tamper evidence band portion 34, the plurality of small diameter portions 35*a*, and the plurality of large diameter portions 35*b* in the skirt portion 22 together with the first tool 211. As illustrated in FIGS. 10 to 16, the second tool 212 includes a second base portion 231, a plurality of second protrusions 232, and a second tamper-evidence-band-portion forming portion 233 provided on the second base portion 231.

The second base portion 231 has, for example, an arc plate shape. For example, the outer diameter of the second base portion 231 is set to be larger than the outer diameter of the first base portion 221 and the outer diameter of the skirt portion 22. The second base portion 231 may have a disk shape, a quarter circle shape, or a semicircle shape as long as it has an outer peripheral surface with a radius of curvature capable of suitably forming the plurality of locking portions 31, the plurality of vent slit portions 32, the plurality of small diameter portions 35*a*, and the plurality of large diameter portions 35*b* together with the first tool 211. Further, the second base portion 231 may be rotatable, or may be configured not to be rotated if the first base portion 221 is configured to be rotated.

For example, the tip of the second protrusion 232 is formed in a curved surface shape, and one end side in the axial direction (the top plate portion 21 side of the skirt portion 22) is formed in a flat surface shape. In addition, the second protrusion 232 is formed in a shape in which the width gradually decreases toward the tip in the axial direction and the direction orthogonal to the axial direction.

As illustrated in FIG. 10, the second protrusion 232 includes, for example, first teeth 232A for forming the vent slit portions 32 and second teeth 232B for forming the locking portions 31. Here, the first teeth 232A and the second teeth 232B are formed in different shapes so as to suitably form the vent slit portions 32 and the locking portions 31, respectively, but may alternatively be formed in the same shape as long as the locking portions 31 and the vent slit portions 32 can be suitably formed.

The second tamper-evidence-band-portion forming portion 233 forms the skirt portion 22 in the shape of the tamper evidence band portion 34 together with the first tamper-evidence-band-portion forming portion 226, and forms the plurality of breaking portions 34*a* by intermittently forming slits.

The end face of the tip of the second protrusion 232 enters between the adjacent first protrusions 222, thereby pressing the skirt portion 22 to form a recessed portion. As a specific example of step ST5 of the manufacturing method described above, the first tool 211 and the second tool 212 are relatively moved in a state in which the first base portion 221 of the first tool 211 is inserted into the molded product 11A. Then, as illustrated in FIGS. 11 to 13, the end faces of the tips of the second projections 232 sequentially enter between the adjacent first projections 222, thereby pressing the skirt portion 22. At this time, the end faces of the second protrusions 232 are located closer to the center of the first base portion 221 than the radially outer surfaces of the small-diameter-portion forming portions 224 in the radial direction of the first tool 211.

For example, in a case where the cutter portion 223 is adjacent to the first protrusion 222 in the axial direction, as shown in FIG. 11, the vent slit 32*b* is formed in a part of the recessed portion by the cutter portion 223 and the first teeth 232A of the second protrusion 232 during formation of the recessed portion, and the recessed portion constitutes the vent slit portion 32.

In a case where the cutter portion 223 is not adjacent to the end portion of the first protrusion 222 in the axial direction, as shown in FIG. 12, the recessed portion formed by the second teeth 232B of the second protrusion 232 constitutes the locking portion 31.

Further, at this time, as shown in FIG. 12, the second projection 232 moves a portion constituting the upper annular portion 35 on the top plate portion 21 side of the skirt portion 22 toward the small-diameter-portion forming portion 224 which is a recess. As a result, a portion of the skirt portion 22 adjacent to the locking portion 31 on the top plate portion 21 side is drawn toward the small-diameter-portion forming portion 224 and plastically deformed so as to be recessed, thereby forming the small diameter portion 35*a*. In addition, a portion adjacent to the small diameter portion 35*a* in the circumferential direction is pressed against the large-diameter-portion forming portion 225, and the large diameter portion 35*b* is formed adjacent to the small diameter portion 35*a*. The large diameter portion 35*b* is formed in a portion of the upper annular portion 35 adjacent to the vent slit portion 32.

The driving device 213 is a driving source that relatively rotates the first tool 211 and the second tool 212. The driving device 213 rotates, for example, the rotary shaft 227. The driving device 213 is, for example, a motor or a transmission mechanism that transmits rotation of the motor to the rotary shaft 227. The driving device 213 rotates the first tool 211 in one direction.

The driving device 213 need only relatively rotate the first tool 211 and the second tool 212, and may be configured to rotate the second base portion 231 of the second tool 212 instead of rotating the first base portion 221 via the rotary shaft 227 of the first tool 211, or may rotate both the first base portion 221 and the second base portion 231. For example, the driving device 213 may be configured to be movable between an initial position at which the cap body 11 is disposed on the first tool 211 and a molding position at which the first tool 211 and the second tool 212 are in a predetermined positional relationship to mold the cap body 11.

According to the cap 1 configured as described above and the method for manufacturing the cap 1, the skirt portion 22 (the upper annular portion 35) between the top plate portion 21 and the plurality of locking portions 31 has the small diameter portions 35*a* in which the inner diameter above the locking portions 31 is smaller than the inner diameter above the portion where the locking portions 31 are not formed. Thus, the metallic material that existed before formation of the small diameter portions 35*a* at the position where the small diameter portions 35*a* are set to be formed is drawn radially inward when the locking portions 31 are formed. Therefore, without damaging the skirt portion 22, the locking portions 31 can be formed deeply inward in the radial direction, and the inscribed circle diameter of the plurality of locking portions 31 can be reduced. That is, the inscribed circle diameter of the plurality of locking portions 31 can be smaller than the outer diameter of the sealing member 12. Since the sealing member 12 can be supported by the plurality of locking portions 31, it is possible to reliably prevent the sealing member 12 from falling off from the cap body 11.

Furthermore, by setting the inner diameter of the inscribed circle of the plurality of small diameter portions 35*a* to be smaller than the outer diameter of the sealing member 12, the inner peripheral surfaces of the small diameter portions 35*a* come into contact with the outer peripheral edge of the sealing member 12, so that the inner peripheral surfaces of the small diameter portions 35*a* retain the sealing member 12. Therefore, the cap body 11 can fix the outer peripheral portion of the sealing member 12 via the small diameter portions 35*a* in addition to support by the plurality of locking portions 31, and can more reliably prevent the sealing member 12 from falling off the cap body 11. In addition, the sealing member 12 disposed in the cap body 11 is positioned in the radial direction by the inner peripheral surfaces of the plurality of small diameter portions 35*a*. Therefore, when the cap 1 is attached to the can container 100, the thick portion 42*c* of the sealing member 12 reliably faces the mouth portion 110 of the can container 100, so that the cap 1 can reliably seal the can container 100.

As described above, according to the cap 1 and the method for manufacturing the cap 1 of the embodiment of the present invention, the plurality of locking portions 31 supporting the sealing member 12 can be formed without damaging the skirt portion 22, and the locking portions 31 can be formed deeply. Therefore, the cap 1 and the method for manufacturing the cap 1 can reliably prevent the sealing member 12 from falling off the cap body 11.

Note that the present invention is not limited to the embodiment described above. For example, although the numbers of the plurality of locking portions 31 and the plurality of vent slit portions 32 have been described as examples, the numbers of the locking portions 31 and the vent slit portions 32 can be set as appropriate. That is, the number of the locking portions 31 may be the same as the number of the vent slit portions 32, or greater or lesser than the number of the vent slit portions 32. In addition, the shapes of the locking portion 31 and the vent slit portion 32 can be appropriately set. In addition, the position and the opening area of the vent slit 32*b* of the vent slit portion 32 can be appropriately set.

That is, as long as the sealing member 12 can be supported by the plurality of locking portions 31, the numbers, shapes, and the like of the locking portions 31 and the vent slit portions 32 can be appropriately set depending on the shapes of the cap 1 and the can container 100, the contents to be contained in the can container 100, the internal pressure in the can container 100, and the like.

That is, the present invention is not limited to the above-described embodiment, and in the practical stage, various modifications may be made without departing from the spirit of the invention. Furthermore, embodiments may be appropriately combined and implemented, and in that case, the combined effects may be obtained. Furthermore, the embodiment described above includes various inventions, and various inventions can be extracted by a combination selected from structural elements disclosed herein. For example, if the object of the invention is achieved and the advantages of the invention are attained even after some of the structural elements disclosed in connection with the embodiments are deleted, the structure made up of the resultant structural elements can be extracted as an invention.

REFERENCE SIGNS LIST

1: cap, 11: cap body, 11A: molded product, 12: sealing member, 12*a*: flat plate portion, 12*b*: curved surface portion, 21: top plate portion, 22: skirt portion, 23: corner portion, 31: locking portion, 31*a*: upper inclined surface, 31*b*: lower inclined surface, 32: vent slit portion, 32*a*: recessed portion, 32*b*: vent slit, 33: female screw portion, 34: tamper evidence band portion, 34*a*: breaking portion, 35: upper annular portion, 35*a*: small diameter portion, 35*b*: large diameter portion, 41: sliding layer, 41*a*: first flat plate portion, 41*b*: first curved surface portion, 41*c*: protruding portion, 42: sealing layer, 42*a*: second flat plate portion, 42*b*: second curved surface portion, 42*c*: thick portion, 100: can container, 110: mouth portion, 111: jaw portion, 112: male screw portion, 113: curl portion, 200: manufacturing apparatus, 211: first tool, 212: second tool, 213: driving device, 221: first base portion, 221*a*: hole, 222: first protrusion, 223: cutter portion, 224: small-diameter-portion forming portion, 225: large-diameter-portion forming portion, 226: first tamper-evidence-band-portion forming portion, 227: rotary shaft, 231: second base portion, 232: second protrusion, 232A: first teeth, 232B: second teeth, 233: second tamper-evidence-band-portion forming portion.

What is claimed is:

1. A cap comprising:

a cap body including a top plate portion and a cylindrical skirt portion provided on a peripheral edge portion of the top plate portion;

a sealing member provided in the cap body and separately from the cap body so as to face the top plate portion;

a plurality of locking portions arranged in a circumferential direction in the skirt portion, the locking portions protruding inward in a radial direction of the skirt portion and supporting the sealing member;

a plurality of small diameter portions arranged between the top plate portion and the locking portions of the skirt portion, the small diameter portions being respectively provided on a top plate portion side of the locking portions in an axial direction, wherein each of the small diameter portions is adjacent to the top plate portion and adjacent to a corresponding one of the locking portions; and a plurality of large diameter portions provided adjacent to the small diameter portions in the circumferential direction and having an inscribed circle diameter larger than an inscribed circle diameter of the plurality of small diameter portions.

2. The cap according to claim 1, wherein the inscribed circle diameter of the plurality of small diameter portions is smaller than an outer diameter of the sealing member.

3. The cap according to claim 1, comprising a plurality of vent slit portions arranged in the circumferential direction of the skirt portion.

4. The cap according to claim 2, comprising a plurality of vent slit portions arranged in the circumferential direction of the skirt portion.

5. A method for manufacturing a cap comprising:

arranging a molded product including a top plate portion and a skirt portion integrally formed with the top plate portion via an annular and curved corner portion in a first tool including a plurality of first protrusions on an outer peripheral surface thereof, a plurality of large-diameter-portion forming portions adjacent to the first protrusions in an axial direction, and small-diameter-portion forming portions adjacent to the large-diameter-portion forming portions in a circumferential direction; and forming a plurality of recessed portions, a plurality of small diameter portions, and a plurality of large diameter portions in the skirt portion by relatively rotating the first tool and a second tool including second protrusions arranged between the adjacent first protrusions of the first tool and causing the second protrusions to enter between the adjacent first protrusions, wherein each of the small diameter portions is adjacent to the top plate portion and adjacent to a corresponding locking portion of a plurality of locking portions, and wherein the plurality of locking portions are arranged in a circumferential direction in the skirt portion.

6. The method for manufacturing a cap according to claim 5, comprising inserting a sealing member into the molded product after the recessed portions and the small diameter portions are formed.

7. The method for manufacturing a cap according to claim 6, wherein an inscribed circle diameter of the plurality of small diameter portions is smaller than an outer diameter of the sealing member.

8. The method for manufacturing a cap according to claim 5, wherein the first tool includes a plurality of cutter portions configured to form vent slit portions in a part of the recessed portions.

9. The method for manufacturing a cap according to claim 6, wherein the first tool includes a plurality of cutter portions configured to form vent slit portions in a part of the recessed portions.

10. The method for manufacturing a cap according to claim 7, wherein the first tool includes a plurality of cutter portions configured to form vent slit portions in a part of the recessed portions.

* * * * *